US011688922B2

(12) United States Patent
Liu et al.

(10) Patent No.: US 11,688,922 B2
(45) Date of Patent: Jun. 27, 2023

(54) COLOR CHANGING TELEVISION ANTENNA WITH LED

(71) Applicant: Jiangxi Innovation Technology Co., Ltd., Ji'an (CN)

(72) Inventors: Xiaobing Liu, Ji'An (CN); Qin Li, Ganzhou (CN)

(73) Assignee: Jiangxi Innovation Technology Co., Ltd., Ji'An (CN)

( * ) Notice: Subject to any disclaimer, the term of this patent is extended or adjusted under 35 U.S.C. 154(b) by 515 days.

(21) Appl. No.: 16/980,783

(22) PCT Filed: Jul. 30, 2020

(86) PCT No.: PCT/CN2020/105658
§ 371 (c)(1),
(2) Date: Sep. 14, 2020

(87) PCT Pub. No.: WO2022/000673
PCT Pub. Date: Jan. 6, 2022

(65) Prior Publication Data

US 2023/0155272 A1 May 18, 2023

(30) Foreign Application Priority Data

Jun. 30, 2020 (CN) ..... 202010612938.4

(51) Int. Cl.

| | |
|---|---|
| ***H01Q 1/06*** | (2006.01) |
| ***H01Q 1/22*** | (2006.01) |
| ***F21V 23/00*** | (2015.01) |
| ***H01Q 1/50*** | (2006.01) |
| ***F21V 14/08*** | (2006.01) |

(Continued)

(52) U.S. Cl.
CPC ..... *H01Q 1/06* (2013.01); *F21V 14/08* (2013.01); *F21V 23/003* (2013.01); *H01Q 1/22* (2013.01); *H01Q 1/50* (2013.01); *F21Y 2113/13* (2016.08); *F21Y 2115/10* (2016.08)

(58) Field of Classification Search
CPC ..... F21V 33/0052; H01Q 1/06; H01Q 1/22
See application file for complete search history.

(56) References Cited

U.S. PATENT DOCUMENTS

2009/0051620 A1* 2/2009 Ishibashi ..... H01Q 9/16 343/897
2016/0149288 A1* 5/2016 Wang ..... H01Q 1/38 343/906

(Continued)

*Primary Examiner* — Jason Crawford
(74) *Attorney, Agent, or Firm* — Jeenam Park

(57) ABSTRACT

A color changing television antenna with LED includes a casing, an antenna radiator in the casing, a coaxial cable situated at a rear end of the casing and connected to the antenna radiator. The casing contains an LED lamp, and a transparent display panel extending to the outside from the display panel. The part of the display panel inside the casing has a receiving slot for installing the LED lamp and allowing the LED lamp to project light onto a sidewall of the receiving slot. The display panel transmits the projected light by total reflection. A reflector is installed on a surface of the display panel for reflecting the light transmitted inside the display panel and forming a predetermined pattern. This television antenna can display a specific pattern and improve the display effect based on the principle of total reflection of the transparent display panel.

10 Claims, 9 Drawing Sheets

(51) Int. Cl.
*F21Y 113/13* (2016.01)
*F21Y 115/10* (2016.01)

(56) References Cited

U.S. PATENT DOCUMENTS

2019/0323683 A1* 10/2019 Moriya ..... F21V 9/00
2021/0083358 A1* 3/2021 Shao ..... H01Q 1/12

* cited by examiner

COLOR CHANGING TELEVISION ANTENNA WITH LED

FIELD OF INVENTION

The present invention relates to the field of television antennas, in particular to a color changing television antenna with light emitting diodes (LEDs).

BACKGROUND OF INVENTION

Description of the Related Art

Digital television (DTV) antenna is a core component for wireless signal transmissions of a digital television. In the operating principle of a conventional active DTV antenna, an antenna radiator is used to receive radio signals in form of weak electromagnetic waves in the air, and a coaxial cable is used to send the signals to an amplifier for amplification and then output the amplified signals. To increase the fun and appearance of the television antenna, some luminous television antennas with the light emitting diodes (LEDs) are launched on the market, and these television antennas generally use a single LED for the luminous display, and thus the display mode is monotonous, and the display effect is poor.

SUMMARY OF THE INVENTION

To overcome the drawbacks of the prior art, the present invention provides a color changing television antenna with LED to display specific patterns and improve the display effect based on the principle of total reflection of a transparent display panel.

To achieve the aforementioned and other objectives, the present invention discloses a color changing television antenna with LED, comprising: a casing, an antenna radiator installed in the casing, a coaxial cable disposed at a rear end of the casing and coupled to the antenna radiator, and the casing having an LED lamp and a transparent display panel contained therein, and the display panel extending to the outside from the casing, and the part of the display panel situated inside the casing having a receiving slot for installing the LED lamp, and a light being projected onto an inner sidewall of the receiving slot, and the display panel transmitting the light projected onto the inner sidewall of the receiving slot by total reflection, and the display panel having a reflector installed on a surface thereof and provided for reflecting the light transmitted inside the display panel out of the display panel, and the reflector forming a predetermined pattern.

Preferably, the casing has a fixed plate disposed at a surface of the display panel, and the LED lamp is fixed onto the surface of the fixed plate.

Preferably, the fixed plate is rotatably coupled to a mask, and the mask is disposed between the LED lamp and the inner sidewall of the receiving slot and covered onto an outer side of the LED lamp, and the mask has a light transmitting opening; the display panel has a plurality of reflection areas on a surface thereof, and each reflection area has the reflector; and the fixed plate has a rotary driver installed thereon for driving the mask to rotate to the light transmitting opening and to be configured to be facing different display areas.

Preferably, the fixed plate includes a fixed portion, and the fixed plate has a ring groove formed around the fixed portion and penetrating through the fixed plate, and the ring groove has a gap, and the LED lamp is installed on a lower surface of the fixed portion, and a rotating plate is disposed on an upper surface of the fixed portion, and the mask is fixed onto the lower surface of the rotating plate, passed through the ring groove, and rotated along the ring groove, and the rotary driver and the rotating plate are fixedly coupled to each other.

Preferably, the fixed portion has a connecting plate disposed at the lower surface thereof and configured to be perpendicular to the fixed plate, and the LED lamp is fixed onto the connecting plate, and the LED lamp has a light-emitting surface configured to be facing the inner sidewall of the receiving slot.

Preferably, the LED lamp is in a substantially semicircular shape, and the LED lamp has a circular arc surface facing the inner sidewall of the receiving slot, and the inner sidewall of the receiving slot and the mask are in a circular arc shape.

Preferably, the casing comprises an upper casing and a lower casing, and the upper casing and the lower casing are fixed onto the upper surface and the lower surface of the display panel respectively; and the display panel comprises a penetrating fixing hole, and a connecting column coupled between the upper casing and the lower casing and passing through the fixing hole.

Preferably, the part of the display panel situated inside the casing has a placement slot extending along the widthwise direction of the display panel, and the receiving slot has a plurality of sidewalls extending in a direction along the placement slot and distributed in the placement slot.

Preferably, the casing has a dimming circuit installed therein and coupled to the LED lamp, and a surface of the casing has a button electrically coupled to the dimming circuit for changing a dimming strategy, and the LED lamp is a multi-color LED lamp.

Preferably, the LED lamp comprises three color (red, blue, and green) LED lamps, and the button comprises a first key switch and a second key switch, and the dimming circuit comprises a chip SN8P2501, a first triode, a second triode and a third triode, a DC power, the blue LED lamp, a first current limiting resistor and a collector of the first triode sequentially and electrically coupled with one another; the DC power, the green LED lamp, a second current limiting resistor and a collector of the second triode sequentially and electrically coupled to one another; the DC power, the red LED lamp, a third current limiting resistor and a collector of the third triode sequentially and electrically coupled to one another; an emitter of the first triode, an emitter of the second triode and an emitter of the third triode being grounded; a base of the first triode, a base of the second triode, and a base of the third triode respectively and electrically coupled to a Pin 3, a Pin 5, and a Pin 6 of the chip SN8P2501; the DC power, a first connected resistor and a Pin 4 of the chip SN8P2501 sequentially and electrically coupled to one another; the Pin 4 of the chip SN8P2501, the first key switch and a ground terminal sequentially and electrically coupled to one another; the DC power, a second connected resistor and a Pin 7 of the chip SN8P2501 sequentially and electrically coupled to one another; and the Pin 7 of the chip SN8P2501, the second key switch and the ground terminal sequentially and electrically coupled to one another.

The present invention has the following technical effects. In the present invention, the transparent display panel is mounted onto the television antenna, and the part of the display panel situated inside the casing has the receiving slot, and the receiving slot has the LED lamp installed therein for emitting light in a direction towards the inner sidewall of the receiving slot, and the display panel transmits the light projected onto the inner sidewall of the receiving slot by the principle of total reflection, and the reflector at the surface of the display panel can reflect the light of LED lamp, and the reflector with the predetermined pattern can display the predetermined pattern on the display panel. Compared with the conventional monotonous LED lamp, the present invention can improve the display effect and provide diversified display methods.

BRIEF DESCRIPTION OF NUMERALS USED IN THE DRAWINGS

1: Casing; 11: Upper casing; 12: Lower casing; 13: Connecting column; 100: LED lamp; 2: Display panel; 20: Placement slot; 21: Receiving slot; 22: Fixing hole; 200: Reflector; 201: First reflection area; 202: Second reflection area; 3: Coaxial cable; 4: Fixed plate; 41: Fixed portion; 42: Ring groove; 43: Gap; 44: Connecting plate; 51: Mask; 52: Rotating plate; 510: Light transmitting opening.

DESCRIPTION OF THE PREFERRED EMBODIMENTS

To make it easier for our examiner to understand the objective of the invention, its structure, innovative features, and performance, we use a preferred embodiment together with the attached drawings for the detailed description of the invention.

Figure 1:
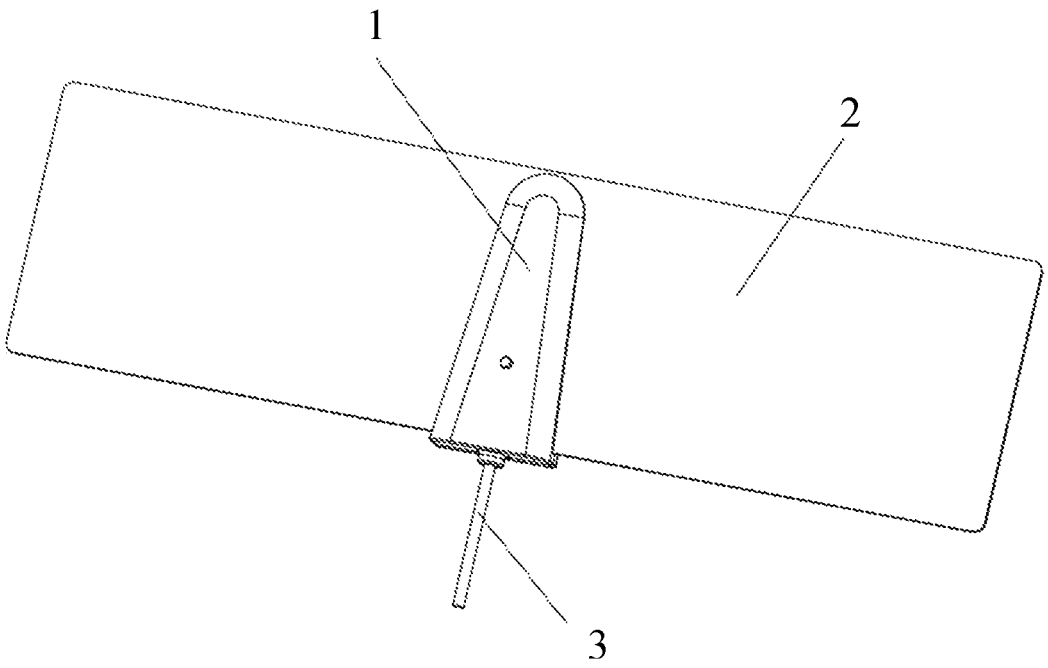
FIG. 1 is a schematic view of a color changing television antenna with LED in accordance with an embodiment the present invention.
Figure 2:
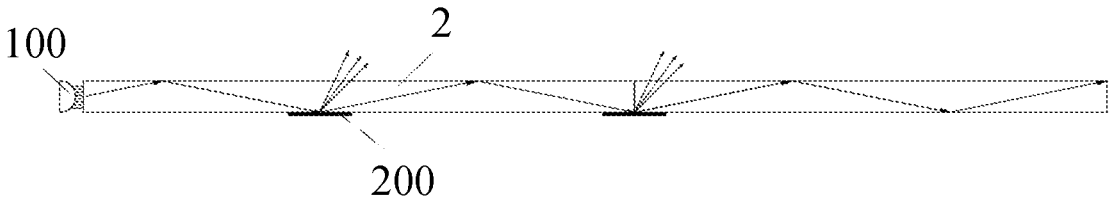
FIG. 2 is a side view of a display panel in accordance with an embodiment of the present invention.
Figure 3:
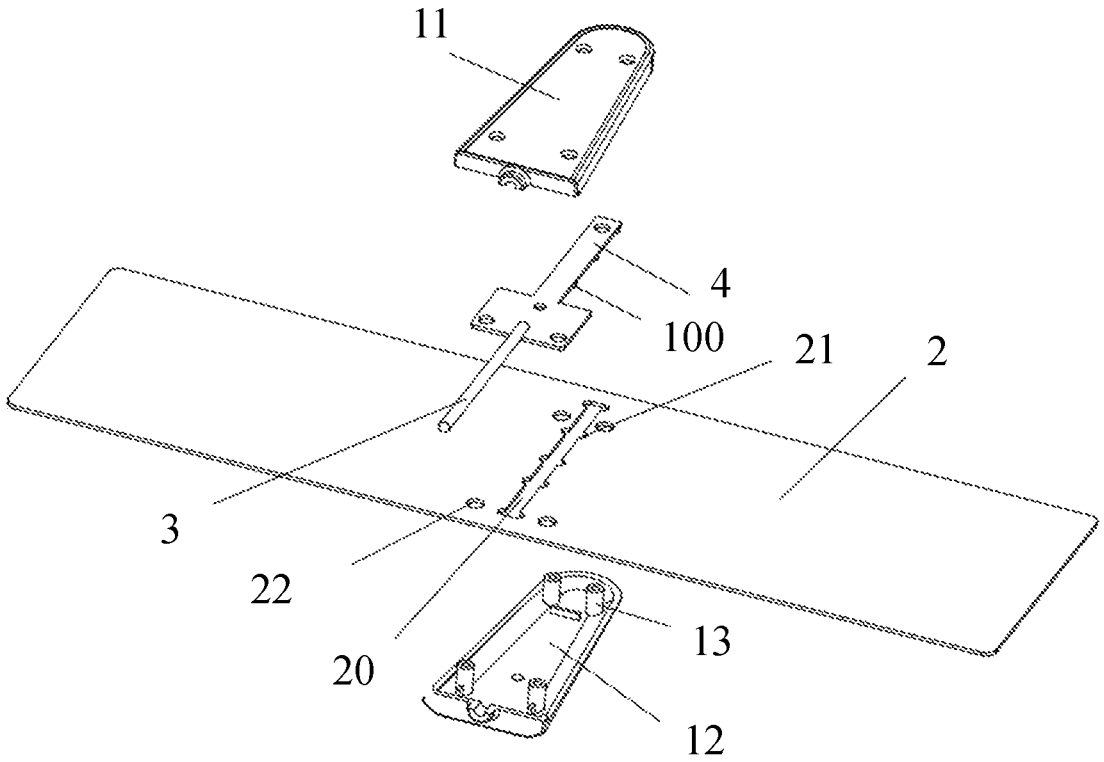
FIG. 3 is an exploded view of a color changing television antenna with LED in accordance with an embodiment of the present invention.

With reference to FIGS. 1 to 3 for a color changing television antenna with LED in accordance with an embodiment of the present invention, the color changing television antenna comprises a casing 1, an antenna radiator installed in the casing 1 for receiving electromagnetic signals, and a coaxial cable 3 installed at a rear end of the casing 1 for outputting the received signals. In the casing 1, an LED lamp 100 and a transparent display panel 2 are installed, and the display panel 2 is made of a transparent material such as an acrylic board or any other transparent board. The display panel 2 is a substantially rectangular structure extending along the lengthwise direction, and the display panel 2 is fixed into the casing 1, and the casing 1 has an open slot penetrating through the casing 1, and both ends of the display panel 2 extend to the outside of the casing 1 from the open slot.

The display panel 2 has a receiving slot 21 formed in the casing 1 and penetrating through the display panel 2 along the thick-wise direction of the display panel 2. The LED lamp 100 is installed at the receiving slot 21 for projecting a light in a direction towards an inner sidewall of the receiving slot 21. A power supply unit such as a battery can be installed in the casing 1 for supplying electric power to the LED lamp 100, so that the LED lamp 100 can be lit. The LED lamp 100 has a main light emission direction parallel to the lengthwise direction of the display panel 2, so that the light can be transmitted to the whole display panel 2 as much as possible. Since the display panel 2 is transparent, the light can pass into the display panel 2 through the inner sidewall of the receiving slot 21, and the display panel 2 can transmit the light incident into the inner sidewall of the receiving slot 21 based on the principle of total reflection. In FIG. 2, when the light is projected onto the upper surface and the lower surface of the display panel 2, the total reflection will occur, and the light will be transmitted forwardly along a surface where the display panel 2 is situated.

A reflector 200 is installed on a surface of the display panel 2, wherein the reflector 200 can be a printed silver paste layer with a very strong reflection property. After the light is shed on the reflector 200, reflection will occur, and the reflection angle is greater than the incident angle, so that the reflected light will not have a total reflection at the surface of the display panel 2, but the reflected light will be reflected out of the display panel 2. The reflector 200 can cover a part of the display panel 2 and be arranged along a predetermined path to form a predetermined pattern, so that when the LED lamp 100 is lit, the reflector 200 reflects the light to light up the predetermined pattern, so as to form a luminous television antenna.

In an embodiment as shown in FIG. 3, the casing 1 has a fixed plate 4 disposed on the upper surface of the display panel 2 and parallelly fixed onto the display panel 2, and the LED lamp 100 is fixed onto a surface of the fixed plate 4 and then extended into the receiving slot 21.

Further, the coaxial cable 3 is fixed onto the fixed plate 4, and the casing 1 has an opening formed at a rear end thereof, and the coaxial cable 3 extends out of the casing 1 from the opening, and the antenna is fixed onto the upper surface of the fixed plate 4.

In the embodiment as shown in FIG. 3, the casing 1 comprises an upper casing 11 and a lower casing 12, and the upper casing 11 and the lower casing 12 are fixed to the upper surface and the lower surface of the display panel 2 respectively, and the upper casing 11 and the lower casing 12 provide a shading effect, so that the light is shed primarily in a direction towards the display panel 2. Both of the upper casing 11 and lower casing 12 are configured to be parallel to the display panel 2. The upper casing 11 and the lower casing 12 are fixed to the display panel 2 in a detachably fixing manner to facilitate users to fix the casing 1 to the display panel 2, or maintain and replace internal components in the casing 1.

Further, the display panel 2 has a plurality of fixing holes 22 penetrating through the display panel 2, and a connecting column 13 is installed and coupled between the upper casing 11 and the lower casing 12 and passed through the fixing hole 22 to enhance the connecting strength of the upper casing 11 and the lower casing 12. The fixed plate 4 can have a mounting hole for passing the connecting column 13 and fixing and installing the fixed plate 4.

In an embodiment, the display panel 2 has a placement slot 20 extending along the widthwise direction of the display panel 2 and disposed in the casing 1. There is a plurality of receiving slots 21 and a corresponding quantity of LED lamps 100, and the receiving slots 21 can be distributed uniformly on a sidewall of the placement slot 20 in the extending direction of the placement slot 20 to increase brightness. Since the display panel 2 is extended to both sides of the casing 1, it is equivalent to two display ends, so that there can be two groups of receiving slots 21 on two sidewalls of the placement slot 20 respectively. The LED lamps 100 in the two groups of the receiving slots 21 emit light towards both ends of the display panel 2 respectively.

In an embodiment, the casing 1 has a circuit board installed therein and fixed onto the upper surface of the fixed plate 4. The circuit board is integrated with an amplifying circuit, and the amplifying circuit has an input terminal for coupling the antenna radiator and an output terminal for coupling the coaxial cable 3, and the amplifying circuit provides a signal amplification effect to amplify the received weak electromagnetic signal.

Figure 4:
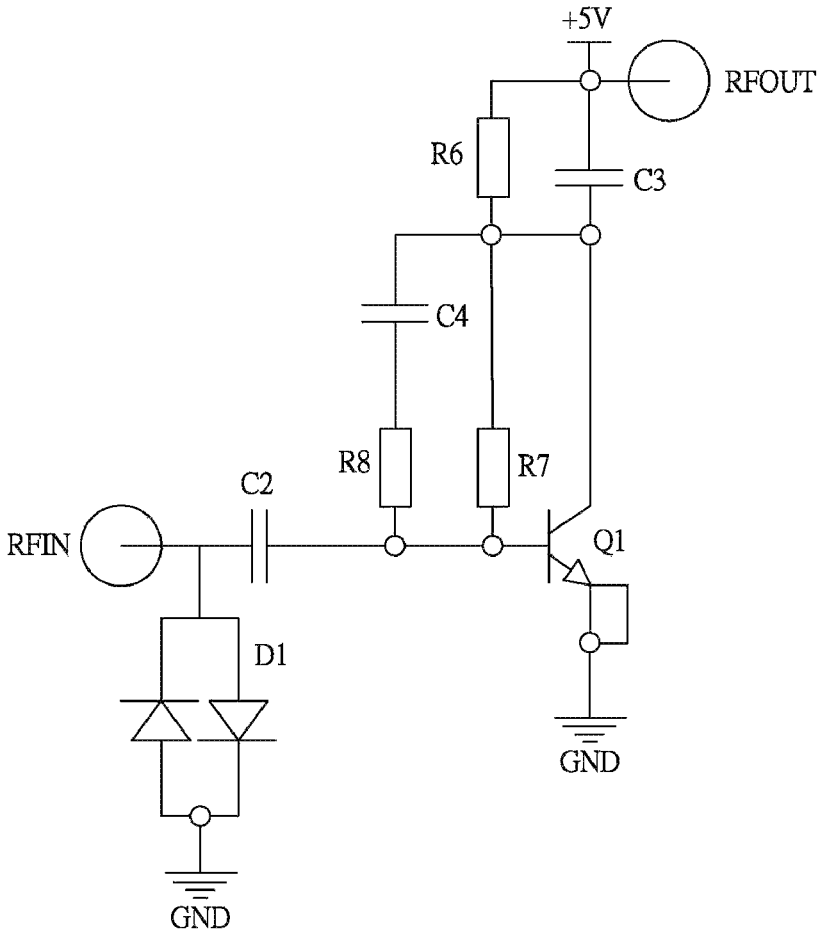
FIG. 4 is a schematic circuit diagram of an amplifying circuit in accordance with an embodiment of the present invention.

In FIG. 4, the amplifying circuit comprises a triode Q1, wherein the triode Q1 has a base serving as an input terminal, a collector serving as an output terminal, and an emitter serving for a grounding purpose. Of course, the input and output terminals can be coupled to a filter circuit and a regulator circuit.

In an embodiment, the casing 1 is further integrated with a dimming circuit which is coupled to the LED lamp 100, and LED lamp 100 is a multi-color LED lamp, and the dimming circuit can output a dimming signal, so that the color and display method of the LED lamp 100 can be changed to provide more diversified display effects of the display panel 2. A button is installed onto a surface of the casing 1 and electrically coupled to the dimming circuit, and users can operate the button to change the dimming strategy of the dimming circuit in order to display different colors.

Figure 5:
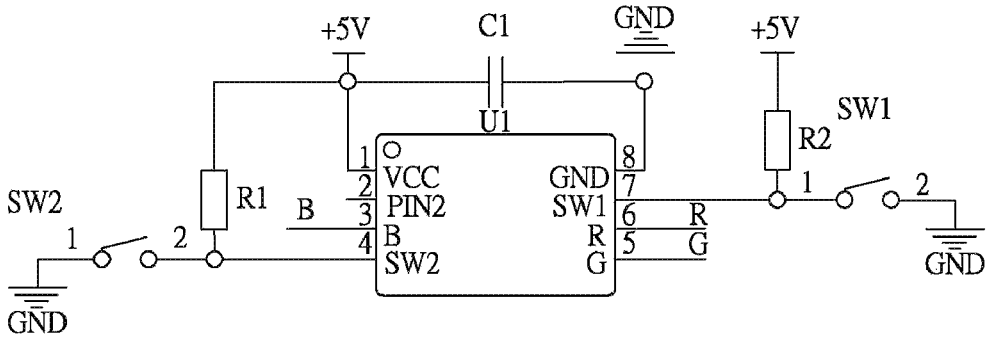
FIG. 5 is a schematic circuit diagram showing a part of a dimming circuit in accordance with an embodiment of the present invention.
Figure 6:
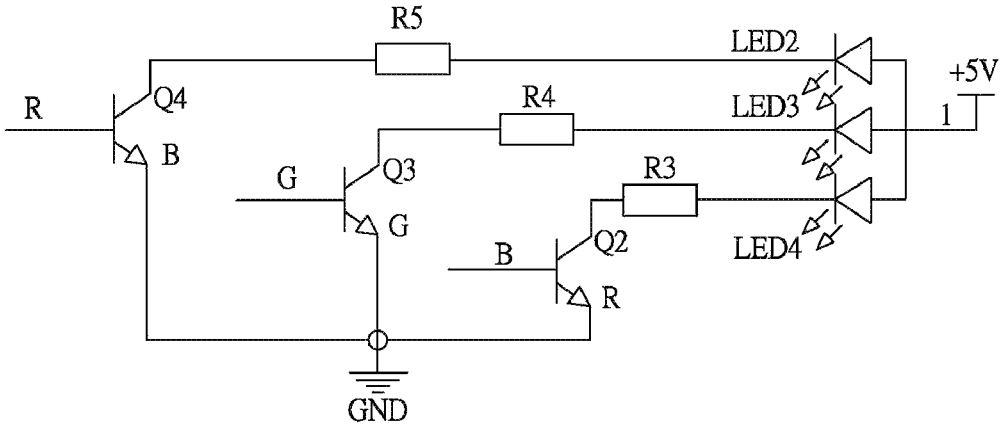
FIG. 6 is a schematic circuit diagram showing another part of the dimming circuit of FIG. 5.

In FIGS. 5 and 6, there are three LED lamps 100 (including red, blue and green) LED lamps, and each LED lamp 100 includes a blue lamp bead LED4, a green lamp bead LED3 and a red lamp bead LED2, and the button comprises a first key switch SW2 and a second key switch SW1. The dimming circuit comprises the chip SN8P2501, a first triode Q2, a second triode Q3, and a third triode Q4. The casing 1 is further integrated with a power supply unit for outputting DC power, and specifically outputting 5V AC signals.

The DC power, the blue lamp bead LED4, the first current limiting resistor R3 and a collector of the first triode Q3 are sequentially and electrically coupled to one another. The DC power, the green lamp bead LED3, the second current limiting resistor R4 and a collector of the second triode are sequentially and electrically coupled to one another. The DC power, the red lamp bead LED2, the third current limiting resistor R5, and a collector of the third triode Q4 are sequentially and electrically coupled to one another. An emitter of the first triode Q2, an emitter of the second triode Q3 and an emitter of the third triode Q4 are grounded. A base of the first triode Q2 is electrically coupled to the Pin 3 of the chip SN8P2501, a base of the second triode Q3 is electrically coupled to the Pin 5 of the chip SN8P2501, and a base of the third triode Q4 is electrically coupled to the Pin 6 of the chip SN8P2501. The Pin 3, Pin 5 and Pin 6 of the chip SN8P2501 output high and low level signals, so that the first triode Q2, second triode Q3 and third triode Q4 can be turned ON or OFF, and the corresponding blue lamp bead LED4, green lamp bead LED3 and red lamp bead LED2 can be turned ON or OFF to achieve a dimming effect.

In the chip SN8P2501, the Pin 1 of the chip SN8P2501 is electrically coupled to a 5V DC power, and a Pin 8 of the chip SN8P2501 is grounded. The 5V DC power, the first connected resistor R1 and the Pin 4 of the chip SN8P2501 are sequentially and electrically coupled to one another. The Pin 4 of the chip SN8P2501, the first key switch and the ground terminal are sequentially and electrically coupled to one another. The DC power, the second connected resistor R2 and a Pin 7 of the chip SN8P2501 are sequentially and electrically coupled to one another. The Pin 7 of the chip SN8P2501, the second key switch, and the ground terminal are sequentially and electrically coupled to one another.

Figure 7:
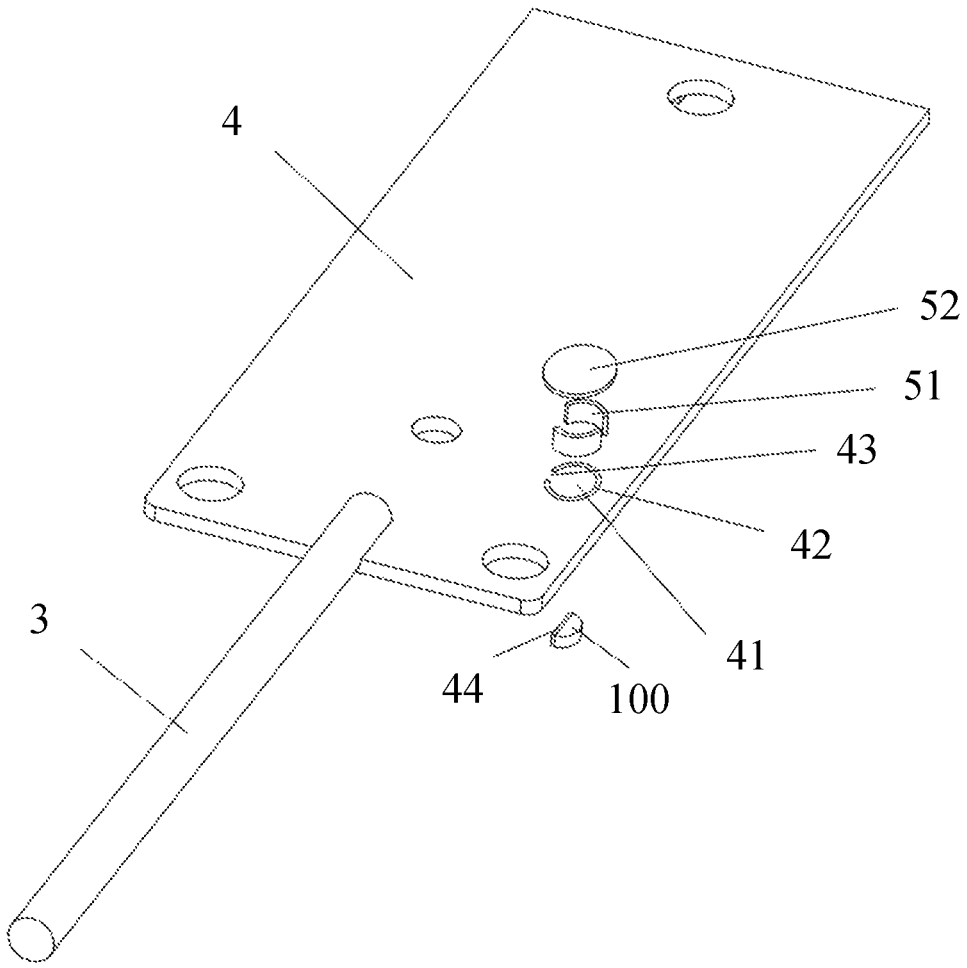
FIG. 7 is a schematic view of a fixed plate in accordance with another embodiment of the present invention.
Figure 8:
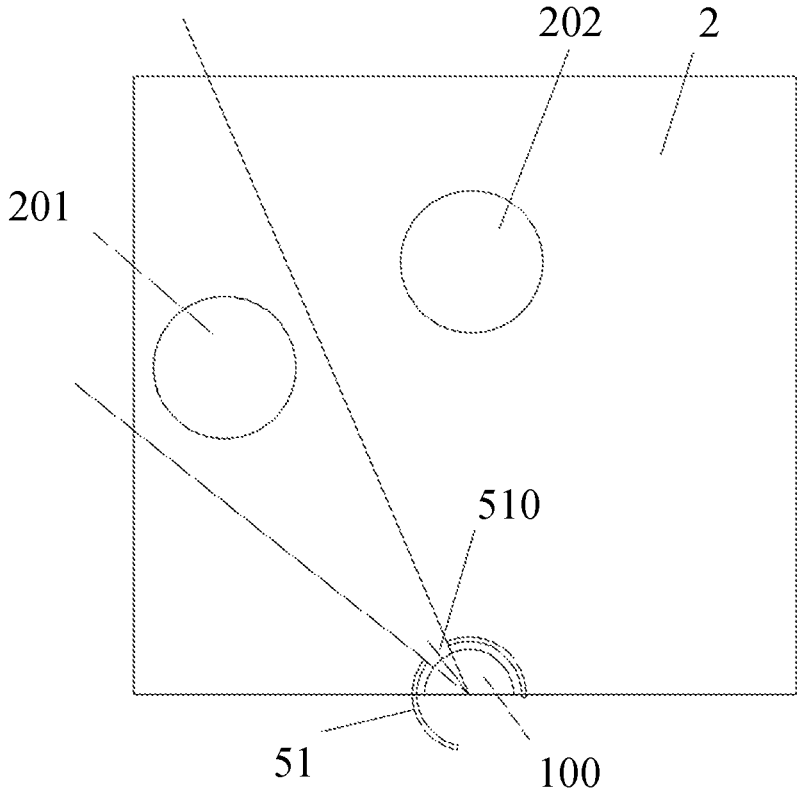
FIG. 8 is a schematic view of the structure with a lighting method in accordance with an embodiment of the present invention.
Figure 9:
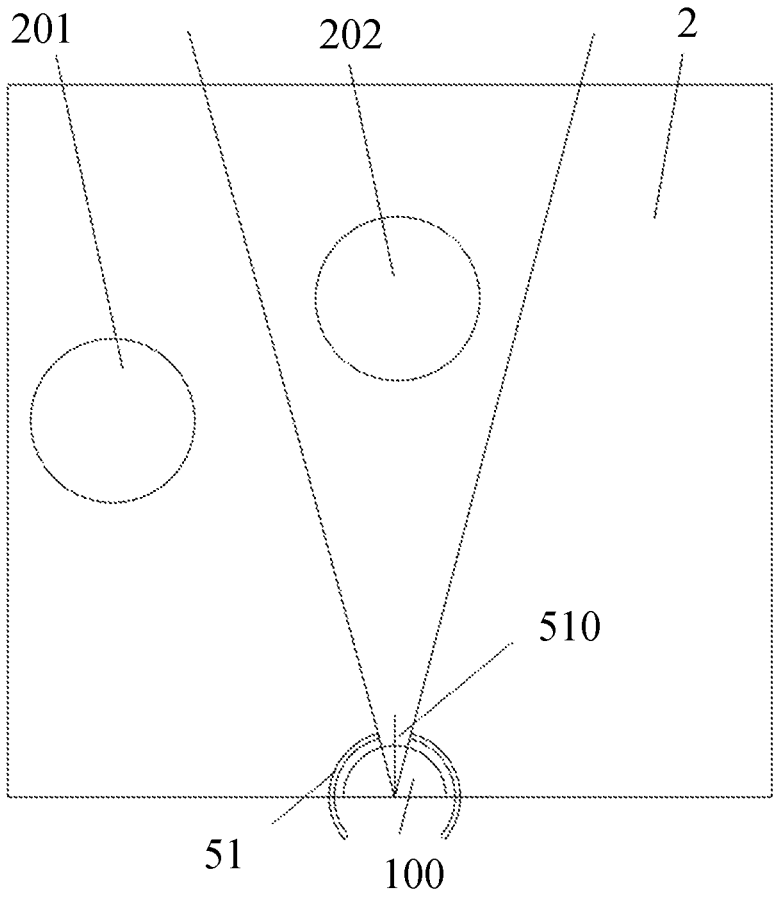
FIG. 9 is a schematic view showing the structure with a lighting method in accordance with another embodiment of the present invention.

The present invention further provides another color changing television antenna with a substantial difference with regard to the structure of the fixed plate 4. In FIGS. 7 to 9, the fixed plate 4 is rotatably coupled to a mask 51, and the mask 51 is disposed between the LED lamp 100 and the inner sidewall of the receiving slot 21 and covered onto the outer side of the LED lamp 100, and the mask 51 provides a shading effect. The mask 51 has a light transmitting opening 510, so that the light of the LED lamp 100 can be outputted from the light transmitting opening 510 only to limit the angle of an emitted light beam and reduce the irradiation range of the light, so that the light of the LED lamp 100 can no longer cover the whole display panel 2, but can just cover a part of the display panel 2. The mask 51 further comprises two arc shades, and the light transmitting opening 510 is formed between the two arc shades.

The display panel 2 has a plurality of reflection areas defined on a surface of the display panel 2 as shown in FIGS. 8 and 9, such as a first reflection area 201 and a second reflection area 202. The fixed plate 4 has a rotary driver (not shown in the figure) installed thereto and coupled to the mask 51 for driving the mask 51 to rotate relative to the LED lamp 100, so that the light transmitting opening 510 can face towards different angles to allow light to be shed on different reflection areas. Each reflection area has a reflector 200, and the reflector 200 in each reflection area can form a different pattern. If the light transmitting opening 510 is configured to be facing a different reflection area, a different pattern will be lit to improve the display effect. The reflection areas can be configured to allow the light passing through the light transmitting opening 510 and to output the light in an overlapped manner, so that when the light transmitting opening 510 is configured to be facing the overlapped reflection areas, the overlapped reflection areas will be lit to further improve the display effect.

The casing 1 further has a control circuit coupled to the rotary driver for controlling the rotary driver according to a set control program, so as to light up the reflection area according to a predetermined display strategy. For example, the light transmitting opening 510 can be controlled to face towards all reflection areas sequentially, so that each reflection area will be lit sequentially, or the light transmitting opening 510 can be configured to be facing some of the reflection areas only.

With reference to FIG. 7 for a specific structure of the mask 51 and the fixed plate 4 which are rotatably coupled to each other in accordance with an embodiment of the present invention, the fixed plate 4 comprises a fixed portion 41, a ring groove 42 formed around the fixed portion 41 of the fixed plate 4 and penetrating through the fixed plate 4, and a gap 43 formed in the ring groove 42, such that the fixed portion 41 can still be fixed onto the fixed plate 4. The LED lamp 100 is installed on the lower surface of the fixed portion 41, and the rotating plate 52 is disposed on the upper surface of the fixed portion 41 and can be rotated on the surface of the fixed plate 4. The mask 51 is fixed onto a lower surface of the rotating plate 52 and passed through the ring groove 42 and can be rotated along the ring groove 42, and the rotary driver and the rotating plate 52 are fixedly coupled to each other. When the rotary driver is operated, the rotating plate 52 drives the mask 51 to move in the ring groove 42, so as to change the facing direction of the light transmitting opening 510.

Further, the lower surface of the fixed portion 41 has a connecting plate 44 configured to be perpendicular to the fixed plate 4, and the LED lamp 100 is fixed onto the connecting plate 44, and the light emitting surface of the LED lamp 100 faces towards the inner sidewall of the receiving slot 21. The LED lamp 100 which is a substantially semicircular structure comprising a planar surface and a circular arc surface, wherein the planar surface is fixed to the connecting plate 44 and the circular arc surface is configured to be facing the inner sidewall of the receiving slot 21, and the inner sidewall of the receiving slot 21 is in a circular arc shape to match with the circular arc surface of the LED lamp 100, and the mask 51 is also designed in a circular arc shape to match with the circular arc surface of the LED lamp 100 in order to achieve a smoother rotation of the mask 51 and prevent touching or hitting the LED lamp 100 or the inner sidewall of the receiving slot 21.

In the aforementioned embodiment, the rotary driver is a micro motor having an output shaft coaxially coupled to the rotating plate 52.

While the invention has been described by means of specific embodiments, numerous modifications and variations could be made thereto by those skilled in the art without departing from the scope and spirit of the invention set forth in the claims.

What is claimed is:

1. A color changing television antenna with LED, comprising: a casing, an antenna radiator installed in the casing, a coaxial cable disposed at a rear end of the casing and coupled to the antenna radiator, and the casing having an LED lamp and a transparent display panel contained therein, and the display panel extending to the outside from the casing, and the part of the display panel situated inside the casing having a receiving slot for installing the LED lamp, and a light being projected onto an inner sidewall of the receiving slot, and the display panel transmitting the light projected onto the inner sidewall of the receiving slot by total reflection, and the display panel having a reflector installed on a surface thereof and provided for reflecting the light transmitted inside the display panel out of the display panel, and the reflector forming a predetermined pattern.

2. The color changing television antenna with LED as claimed in claim 1, wherein the casing has a fixed plate disposed at the surface of the display panel, and the LED lamp is fixed onto the surface of the fixed plate.

3. The color changing television antenna with LED as claimed in claim 2, wherein the fixed plate is rotatably coupled to a mask, and the mask is disposed between the LED lamp and the inner sidewall of the receiving slot and covered onto an outer side of the LED lamp, and the mask has a light transmitting opening; the display panel has a plurality of reflection areas defined on a surface thereof, and each reflection area has the reflector; and the fixed plate has a rotary driver installed thereon for driving the mask to rotate to the light transmitting opening and face towards different display areas.

4. The color changing television antenna with LED as claimed in claim 3, wherein the fixed plate includes a fixed portion, and the fixed plate has a ring groove formed around the fixed portion and penetrating through the fixed plate, and the ring groove has a gap; the LED lamp is installed on a lower surface of the fixed portion, and a rotating plate is disposed on an upper surface of the fixed portion, and the mask is fixed onto the lower surface of the rotating plate, passed through the ring groove, and rotated along the ring groove, and the rotary driver and the rotating plate are fixedly coupled to each other.

5. The color changing television antenna with LED as claimed in claim 4, wherein the fixed portion has a connecting plate disposed at the lower surface thereof and configured to be perpendicular to the fixed plate, and the LED lamp is fixed onto the connecting plate, and the LED lamp has a light-emitting surface configured to be facing the inner sidewall of the receiving slot.

6. The color changing television antenna with LED as claimed in claim 3, wherein the LED lamp is in a substantially semicircular shape, and the LED lamp has a circular arc surface facing the inner sidewall of the receiving slot, and the inner sidewall of the receiving slot and the mask are in a circular arc shape.

7. The color changing television antenna with LED as claimed in claim 1, wherein the casing comprises an upper casing and a lower casing fixed onto the upper surface and the lower surface of the display panel respectively; and the display panel comprises a penetrating fixing hole and a connecting column coupled between the upper casing and the lower casing and passing through the fixing hole.

8. The color changing television antenna with LED as claimed in claim 1, wherein the part of the display panel situated inside the casing has a placement slot extending along the widthwise direction of the display panel, and the receiving slot has a plurality of sidewalls extending in a direction along the placement slot and distributed in the placement slot.

9. The color changing television antenna with LED as claimed in claim 1, wherein the casing has a dimming circuit installed therein and coupled to the LED lamp, and the casing has a button installed on a surface thereof and electrically coupled to the dimming circuit for changing a dimming strategy, and the LED lamp is a multi-color LED lamp.

10. The color changing television antenna with LED as claimed in claim 9, wherein the LED lamp is a three-color (red, blue, and green) LED lamp, and the button comprises a first key switch and a second key switch, and the dimming circuit comprises a chip SN8P2501, a first triode, a second triode and a third triode, a DC power, the blue LED lamp, a first current limiting resistor and a collector of the first triode sequentially and electrically coupled with one another; the DC power, the green LED lamp, a second current limiting resistor and a collector of the second triode sequentially and electrically coupled to one another; the DC power, the red LED lamp, a third current limiting resistor and a collector of the third triode sequentially and electrically coupled to one another; an emitter of the first triode, an emitter of the second triode and an emitter of the third triode being grounded; a base of the first triode, a base of the second triode, and a base of the third triode respectively and electrically coupled to a Pin 3, a Pin 5, and a Pin 6 of the chip SN8P2501; and the DC power, a first connected resistor and a Pin 4 of the chip SN8P2501 sequentially and electrically coupled to one another; the Pin 4 of the chip SN8P2501, the first key switch and a ground terminal sequentially and electrically coupled to one another; the DC power, a second connected resistor and a Pin 7 of the chip SN8P2501 sequentially and electrically coupled to one another; and the Pin 7 of the chip SN8P2501, the second key switch and the ground terminal sequentially and electrically coupled to one another.

* * * * *